United States Patent [19]

Merchant et al.

[11] Patent Number: 4,810,412

[45] Date of Patent: Mar. 7, 1989

[54] AZEOTROPIC COMPOSITIONS OF 1,1-DIFLUORO-2,2-DICHLOROETHANE AND METHANOL OR ETHANOL

[75] Inventors: Abid N. Merchant, Wilmington, Del.; Jill M. Redenbaugh, Winston-Salem, N.C.

[73] Assignee: E. I. Du Pont de Nemours and Company, Wilmington, Del.

[21] Appl. No.: 180,009

[22] Filed: Apr. 11, 1988

[51] Int. Cl.[4] ..... C11D 7/50

[52] U.S. Cl. ..... 252/171; 134/38; 134/40; 252/67; 252/162; 252/170; 252/364

[58] Field of Search ..... 252/67, 162, 170, 171; 134/38, 40

[56] References Cited

U.S. PATENT DOCUMENTS

| | | | |
|---|---|---|---|
| 4,378,303 | 3/1983 | Hisamoto et al. | 252/171 |
| 4,654,160 | 3/1987 | Wilson et al. | 252/171 |
| 4,655,956 | 4/1987 | Basu et al. | 252/153 |
| 4,659,505 | 4/1987 | Enjo et al. | 252/170 |

*Primary Examiner*—Prince E. Willis
*Assistant Examiner*—Willie J. Thompson
*Attorney, Agent, or Firm*—James E. Shipley

[57] ABSTRACT

Azeotropic mixtures of 1,1-difluoro-2,2-dichloroethane (HCFC-132a) with methanol or ethanol, the azeotropic mixtures being useful in solvent cleaning applications.

9 Claims, No Drawings

AZEOTROPIC COMPOSITIONS OF 1,1-DIFLUORO-2,2-DICHLOROETHANE AND METHANOL OR ETHANOL

BACKGROUND OF THE INVENTION

As modern electronic circuit boards evolve toward increased circuit and component densities, thorough cleaning of the boards after soldering becomes more important. Current industrial processes for soldering electronic components to circuit boards involve coating the entire circuit side of the board with a flux and thereafter passing this coated side of the board over preheaters and through molten solder. The flux cleans the conductive metal parts and promotes adhesion of the solder. Commonly used fluxes consist, for the most part, of rosin used alone or with activating additives such as amine hydrochlorides or oxalic acid derivatives.

After soldering, which thermally degrades part of the rosin, the flux and flux residues are often removed from the board with an organic solvent. The requirements of such a solvent are stringent: a solvent should have a low boiling point, have low toxicity and exhibit high solvent power so that flux and flux residues can be removed without damage to the substrate being cleaned.

While boiling, flammability and solvent power characteristics can often be adjusted by preparing mixtures of solvents, these mixtures are often unsatisfactory because they fractionate to an undesirable degree during evaporation or boiling. Such mixtures also fractionate during recovery, making it difficult to reuse a solvent mixture with the original composition.

On the other hand, azeotropic mixtures, with their constant boiling and constant composition characteristics, have been found to be very useful. Azeotropic mixtures exhibit either a maximum or minimum boiling point and do not fractionate upon boiling. These characteristics are also important in the use of the solvent compositions to remove solder fluxes and flux residues from printed circuit boards. Preferential evaporation of the more volatile components of the solvent mixtures, which would be the case if they were not azeotropes or azeotrope-like, would result in mixtures with changed compositions having less desirable properties, such as lower solvency for rosin fluxes and less inertness toward the electrical components. Unchanging composition during use is also desirable in vapor degreasing operations where redistilled material is generally used for final rinse-cleaning. Thus, the vapor defluxing and degreasing systems act as a still. Unless the solvent composition exhibits a constant boiling point, i.e., is a pure component, an azeotrope or azeotrope-like, fractionation will occur and undesirable solvent distribution may act to upset the safety and effectiveness of the cleaning operation.

A number of chlorofluorocarbon-based azeotrope compositions have been discovered and, in some cases, used as solvents for the removal of solder fluxes and flux residues from printed circuit boards and for miscellaneous vapor degreasing applications. Some of these chlorofluorocarbons currently being used for cleaning and other applications have been theoretically linked to the depletion of the ozone layer. As early as the 1970's, with the initial emergence of the ozone theory, it was known that the introduction of the hydrogen moiety into previously fully halogenated chlorofluorcarbons reduced the chemical stability of these compounds. Hence, these now destabilized hydrogen-containing compounds would be expected to degrade in the lower atmosphere and not reach the stratospheric ozone layer. What is also needed, therefore, are substitute chlorofluorocarbons which have low theoretical ozone depletion potential.

Unfortunately, as is recognized in the art, it is not possible to predict the formation of azeotropes. This obviously complicates the search for new azeotropic compositions which have application in the field. Nevertheless, there is a constant effort in the art to discover new azeotropes or azeotrope-like compositions which have desirable solvency characteristics and particularly a greater range of solvency power.

SUMMARY OF THE INVENTION

According to the present invention, azeotrope or azeotrope-like compositions have been discovered comprising admixtures of effective amounts of 1,1-difluoro-2,2-dichloroethane and an alcohol selected from the group consisting of methanol and ethanol and, more specifically, an admixture of about 87–92 weight percent 1,1-difluoro-2,2-dichloroethane and about 13–8 weight percent methanol or about 94–97 weight percent 1,1-difluoro-2,2-dichloroethane and about 6–3 weight percent ethanol.

The present invention provides nonflammable azeotropes or azeotrope-like compositions which are well suited for solvent cleaning applications.

DETAILED DESCRIPTION OF THE INVENTION

The compositions of the instant invention comprise admixtures of effective amounts of 1,1-difluoro-2,2-dichloroethane ($CHF_2CHCl_2$, normal boiling point about 60.0° C.), with an alcohol selected from the group consisting of methanol and ethanol to form an azeotrope or azeotrope-like mixture. The fluorinated material is also known as HCFC-132a, in the nomenclature conventional to fluorinated aliphatic compounds.

By azeotrope or azeotrope-like composition is meant constant boiling liquid admixtures of two or more substances. These admixtures behave like a single substance in that the vapor produced by partial evaporation or distillation has the same, or substantially the same, composition as does the liquid, i.e., the admixtures distill without a substantial change in composition. Constant boiling compositions characterized as azeotropes or azeotrope-like exhibit either a maximum or minimum boiling point as compared with that of nonazeotropic mixtures of the same substances.

By effective amount is meant the amount of each component of the admixture of the instant invention which, when combined, results in the formation of the azeotrope or azeotrope-like compositions of the instant invention.

It is possible to characterize a constant boiling admixture, which may appear under varying guises depending on the conditions chosen, by any of several criteria:

The composition can be defined as an azeotrope of A and B, since the very term "azeotrope" is at once both definitive and limitative, requiring that effective amounts of A and B form this unique composition of matter which is a constant boiling admixture.

It is well known by those who are skilled in the art that, at differing pressures, the composition of a given azeotrope will vary, at least to some degree. Changes in pressure also change, at least to some degree, the boiling point temperature. Thus, an azeotrope of A and B represents a unique type of relationship but with a variable composition depending upon temperature and/or pressure. Therefore, compositional ranges, rather than fixed compositions, are often used to define azeotropes.

Or, the composition can be defined as a particular weight percent relationship or mol percent relationship of A and B, while recognizing that such specific values describe only one particular such relationship and that in actuality a series of such relationships represented by A and B actually exist for a given azeotrope, varying with changes in pressure.

Or, recognizing that the azeotrope A and B does represent just such a series of relationships, the azeotropic series represented by A and B can be characterzed by defining the azeotrope as a compositions characterized by a boiling point at a given pressure. Thus, identifying characteristics are given without unduly limiting the scope of the invention by a specific numerical composition, which is limited by and is only as accurate as the analytical equipment available.

Binary mixtures of 87–92 weight percent HCFC-132a and 13–8 weight percent methanol are characterized as azeotropes or azeotrope-like compositions in that the mixtures within this range exhibit a substantially constant boiling point at constant pressure. Being substantially constant boiling, the mixtures do not tend to fractionate to any great extent upon evaporation or boiling. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope. The binary composition consisting of about 89.5 weight percent HCFC-132a and 10.5 weight percent methanol has been established, within the accuracy of the fractional distillation method, as a true binary azeotrope, boiling at about 54.0° C. at substantially atmospheric pressure. It is the preferred azeotrope or azeotrope-like composition of the instant invention.

Also, according to the present invention, binary mixtures of 94–97 weight percent HCFC-132a and 6–3 weight percent ethanol are characterized as an azeotrope or azeotrope-like composition in that mixtures within this range exhibit a substantially constant boiling point at constant pressure. Being substantially constant boiling, the mixtures do not tend to fractionate to any great extent upon evaporation or boiling. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope. The binary composition consisting of about 95.4 weight percent HCFC-132a and 4.6 weight percent ethanol has been established, within the accuracy of the fractional distillation method, as a true binary azeotrope, boiling at about 58.0° C. at substantially atmospheric pressure.

The azeotropes of the present invention permit easy recovery and reuse of the solvent from vapor defluxing and degreasing operations because of their azeotropic nature. As an example, the azeotropic mixtures of this invention can be used in cleaning processes such as is described in U.S. Pat. No. 3,881,949, which is incorporated herein by reference.

Another important advantage of the azeotropes or azeotrope-like compositions of the instant invention is that the hydrochlorofluorocarbon component, HCFC-132a, has a low ozone depletion potential of about 0.05 relative to fluorotrichloromethane (CFC-11). It may be useful as a substitute for chlorofluorocarbons currently being used for cleaning and other applications which have higher ozone depletion potentials.

The azeotropes of the instant invention can be prepared by any convenient method including mixing or combining the desired amounts of the components. A preferred method is to weigh the desired amounts of each component, combine them in an appropriate container and mix them thoroughly.

EXAMPLE 1

An apparatus consisting of a flask and a total reflux condenser was used to determine the composition versus boiling temperature characteristics for the azeotropes. Pure HCFC-132a was placed in the flask and brought to boiling at atmospheric pressure, and the temperatures of the boiling liquid and the vapor above the boiling liquid were recorded. Small quantities of methanol or ethanol were then added to the flask. Boiling under reflux was allowed to re-equilibrate after each addition for 10–30 minutes, and the temperatures of the boiling liquid and the vapor above the boiling liquid were noted for each particular mixture composition. In both cases, the mixtures reached a temperature below the normal boiling points of each pure component, confirming the minimum boiling azeotropes. The temperatures recorded were those of the azeotropes, at the azeotropic compositions.

EXAMPLE 2

In order to verify the exact azeotropic compositions and temperatures, two mixtures of HCFC-132a and the individual alcohol (methanol or ethanol) were prepared with the alcohol contents slightly higher and slightly lower than the azeotropic compositions. The mixtures were distilled separately in a distillation apparatus using a packed column which contained approximately 24 theoretical plates at total reflux. Minimum boiling azeotropes were obtained with both alcohol mixture distillates for these systems. Azeotropic compositions were determined by gas chromatography to be 89.5 weight percent HCFC-132a and 10.5 weight percent methanol, and 95.4 weight percent HCFC-132a and 4.6 weight percent ethanol.

EXAMPLE 3

A single-sided circuit board was coated with activated rosin flux, and soldered by passing the board over a preheater to obtain a top side board temperature of approximately 200° F. and then through 500° F. molten solder. The soldered board was defluxed in an azeotropic mixture of 89.5 weight percent HCFC-132a and 10.5 weight percent methanol by suspending it, first, for three minutes in the boiling sump, then one minute in the rinse sump and, thereafter, for one minute in the solvent vapor above the boiling sump. The board thus cleaned had no visible residue remaining on it.

EXAMPLE 4

The circuit board cleaning process of Example 3 was repeated using an azeotropic mixture of 95.4 weight percent HCFC-132a and 4.6 weight percent ethanol. The board thus cleaned had no visible residue remaining on it.

We claim:

1. The azeotrope composition comprising about 87–92 weight percent 1,1-difluoro-2,2-dichloroethane and about 13–8 weight percent methanol.

2. The azeotrope or composition of claim 1 wherein the composition is about 94–97 weight percent 1,1-difluoro-2,2-dichloroethane and about 6–3 weight percent ethanol.

3. The azeotrope composition of claim 1 wherein the composition is about 89.5 weight percent 1,1-difluoro-2,2-dichloroethane and about 10.5 weight percent methanol.

4. The azeotrope composition of claim 1 wherein the composition has a boiling point of about 54° C. at substantially atmospheric pressure.

5. The azeotrope composition of claim 2 wherein the composition is about 95.4 weight percent 1,1-difluoro-2,2-dichloroethane and about 4.6 weight percent ethanol.

6. The azeotrope composition of claim 2 wherein the composition has a boiling point of about 58° C. at substantially atmospheric pressure.

7. A process for cleaning a solid surface which comprises treating said surface with the azeotrope composition of claim 1.

8. The process of claim 7 wherein the solid surface is a printed circuit board contaminated with solder flux and flux residue.

9. The process of claim 7 wherein the solid surface is a metal.

* * * * *

UNITED STATES PATENT AND TRADEMARK OFFICE
Certificate

Patent No. 4,810,412

Patented: March 21, 1989

On petition requesting issuance of a certificate for correction of inventorship pursuant to 35 U.S.C. 116, it has been found that the above-identified patent, through error and without any deceptive intent, improperly sets forth the inventorship.

Accordingly, it is hereby certified that the correct inventorship of this patent is: Abid Nazarali Merchant Signed and Sealed this Seventh Day of May, 1991.

WILLIAM R. DIXON, Jr.

*Supervisory Primary Examiner*
*Patent Examining Group 110*